US006024166A

United States Patent [19]

McGarian et al.

[11] Patent Number: 6,024,166

[45] Date of Patent: Feb. 15, 2000

[54] APPARATUS FOR FORMING A SLOT IN A WELLBORE

[75] Inventors: Bruce McGarian; Rory M. Tulloch, both of Aberdeen, United Kingdom

[73] Assignee: The Red Baron (Oil Tools Rental) Limited, United Kingdom

[21] Appl. No.: 08/875,253

[22] PCT Filed: Nov. 6, 1996

[86] PCT No.: PCT/GB96/02716

§ 371 Date: Sep. 12, 1997

§ 102(e) Date: Sep. 12, 1997

[87] PCT Pub. No.: WO97/17523

PCT Pub. Date: May 15, 1997

[30] Foreign Application Priority Data

Nov. 6, 1995 [GB] United Kingdom ..... 9522688

[51] Int. Cl.[7] ..... E21B 29/00

[52] U.S. Cl. ..... 166/55.2; 175/90

[58] Field of Search ..... 166/55, 55.2, 298; 175/89, 90, 267, 269

[56] References Cited

U.S. PATENT DOCUMENTS

| | | | |
|---|---|---|---|
| 1,406,351 | 2/1922 | Corrigan . | |
| 2,178,554 | 11/1939 | Bowie . | |
| 2,880,964 | 4/1959 | Straitiff . | |
| 3,308,893 | 3/1967 | Wisenbaker et al. . | |
| 3,881,775 | 5/1975 | McPherson et al. . | |
| 5,036,921 | 8/1991 | Pittard et al. | 166/298 |
| 5,253,714 | 10/1993 | Davis et al. . | |

FOREIGN PATENT DOCUMENTS

| | | |
|---|---|---|
| 842549 | 7/1960 | United Kingdom . |
| WO96/04457 | 2/1996 | WIPO . |

*Primary Examiner*—David Bagnell
*Assistant Examiner*—Zakiya Walker
*Attorney, Agent, or Firm*—Howell & Haferkamp, L.C.

[57] ABSTRACT

A chain saw for cutting slots in a wellbore casing and the surrounding formation comprises a pair of cutting chain assemblies (37) rotatably mounted on a body and moveable from a storage position in which the axis of the cutting chain assemblies are parallel to the axis of the tool to a position at right angles to the storage position. The chains are driven by a mud-motor, step-up gearbox, drive shaft (20) and bevel gear (34). The position of the chain arms is controlled by a mud operated piston (44) which is connected by rods (41A) to racks (41) which mesh with pinions provided on the arms of the chain assemblies (37). Pressurization of the drillstring upon which the tool is mounted will cause rotation of the motor to drive the cutting chains and simultaneous downward displacement of the piston (44) to bring the cutting chains into engagement with the casing. When the piston (44) has moved a sufficient distance to bring the cutting chain assemblies 937) to a position perpendicular to the axis of the tool the slot may be increased in size by upward movement of the entire tool as the chains continue to rotate.

12 Claims, 8 Drawing Sheets

APPARATUS FOR FORMING A SLOT IN A WELLBORE

This invention relates to apparatus for forming a slot in a wellbore.

The wellbore may be cased in which case the apparatus of the present invention forms a slot in the casing. For many applications, in addition to forming a slot in the casing the apparatus of the present invention will be used to form the slot in any cement surrounding the casing and in the formation beyond the cement.

In the petroleum and gas extraction industries it is recognized that under certain circumstances it is desirable to form one or more openings in the casing of a wellbore. It is also recognized as desirable under certain circumstances to form openings in the formation surrounding a wellbore. Such techniques are often used for increasing the flow of oil or gas into a wellbore from surrounding formations.

The most common technique for forming the required openings is to lower one or more explosive charges into the well and to detonate those charges so as simultaneously to form openings within any casing located in the well and perforate the surrounding formation. Although such techniques are well established and, under many circumstances, result in an improved yield from a well they suffer from a number of disadvantages and, in particular, are in general unable to penetrate to any significant depth in the surrounding formations. Also, the detonation of the explosives inflicts physical damage on the formations which, at least to some extent, reduces the efficacy of the fractures produced, in terms of improved well yield.

With a view to overcoming the shortcomings of explosive perforation techniques it is proposed in U.S. Pat. No. 3,225,828 to make a slot in the casing of a well and into the formation surrounding the casing by means of a cutting device comprising a housing and a cutting wheel, the cutting wheel being displaceable in use from a position in which it is wholly contained within the casing to a position where the wheel has cut through the casing and into the surrounding formation. Such a system suffers from the disadvantage that the maximum penetration into the surrounding formation which can be obtained is limited by the diameter of the cutting wheel and, as a practical matter, because of the need to support and drive the cutting wheel at its centre the cutting wheel is unable to cut outwardly more than about ⅓ of the inside diameter of the casing.

According to one aspect of the present invention there is provided apparatus for forming an elongate slot in a borehole, the apparatus comprising an endless cutting chain mounted on a cutting arm; a motor for driving the chain, the motor having an output shaft located substantially coaxially with the borehole; drive means connecting the motor to a drive sprocket which itself is drivingly engaged with the chain; and means for rotating the cutting arm from an initial position in which the axis of the cutting arm is substantially parallel to the axis of the borehole and a final position in which the axis of the cutting arm extend obliquely or perpendicularly to the axis of the borehole for cutting a slot; the rotating means comprising a sleeve piston which surrounds the drive means and is located below the motor, a rack driven by the sleeve piston, and a pinion driven by the rack and connected to the chain arm.

Preferably, a gearbox is located between the output shaft and the drive sprocket, the gearbox comprising an epicyclic gear set formed by a sun gear, a ring gear and a set of planetary gears, one of the sun gear, the ring gear and the planetary gears being secured to the output shaft of the motor and another of the sun gear, the ring gear and the planetary gears being secured to the body of the motor.

The planetary gear set may be arranged to drive an output shaft at a speed faster than the rotational speed of the output shaft of the motor, or to drive an output shaft at a speed slower than the rotational output speed of the motor. The drive assembly of the present invention has general applicability to downhole tools, but is particularly advantageous for use in an embodiment of slot cutting machine according to the present invention. More particularly, in order to operate effectively a cutting chain having tungsten carbide or diamond cutting elements must be driven at a substantial linear velocity. Because of the constraints of size imposed by boreholes the required linear speed of the chain can only be obtained if the rotational speed of the input to the chain sprocket is high. Typically, a rotational speed of approximately 4500 rpm is required for a diamond chain, to cut in a grinding action. Unfortunately, downhole motors are not usually capable of producing such a rotational output speed directly and high speed motors are of very small diameter and so are incapable of producing the torque and hence power (typically in excess of 10 kW) necessary to drive the chain. Motors capable of producing this level of power output are typically positive displacement mud motors, and such motors have a maximum rotational speed typically in the order of 1500 rpm. Vane motors, electrodrills or turbodrills could also be used. Turbodrills can rotate at higher free-running speeds but the speed at maximum power is typically half the free-running speed. It is also possible that a positive displacement motor could be air-driven to give higher output speeds rather than using muds. Accordingly, by providing a drive assembly comprising such a motor and a planetary gear set designed to produce a 3:1 speed increase the required 4500 rpm input speed to the chain mechanism can be obtained from a mud motor having an output shaft rotational speed of 1500 rpm. A mud motor is preferred to a turbodrill as its speed on load is usually only 10–20% less than the free-running speed and mud motors are available with a sealed-bearing shaft assembly which is preferable to reduce wear in the chain saw bearings.

The use of an arm rotating mechanism comprising a sleeve piston located surrounding the drive shaft to the chain mechanism and below the motor enables the motor and gearbox assembly to be rigidly connected to drill pipe or coiled tubing and to be of a size which makes maximum use of the available wellbore diameter.

The above and further features and advantages of the invention will become clear from the following description of preferred embodiments thereof, given by way of example only, reference being had to the accompanying drawings wherein:

FIG. 2 being to a larger scale than FIG. 1;

Figure 1:
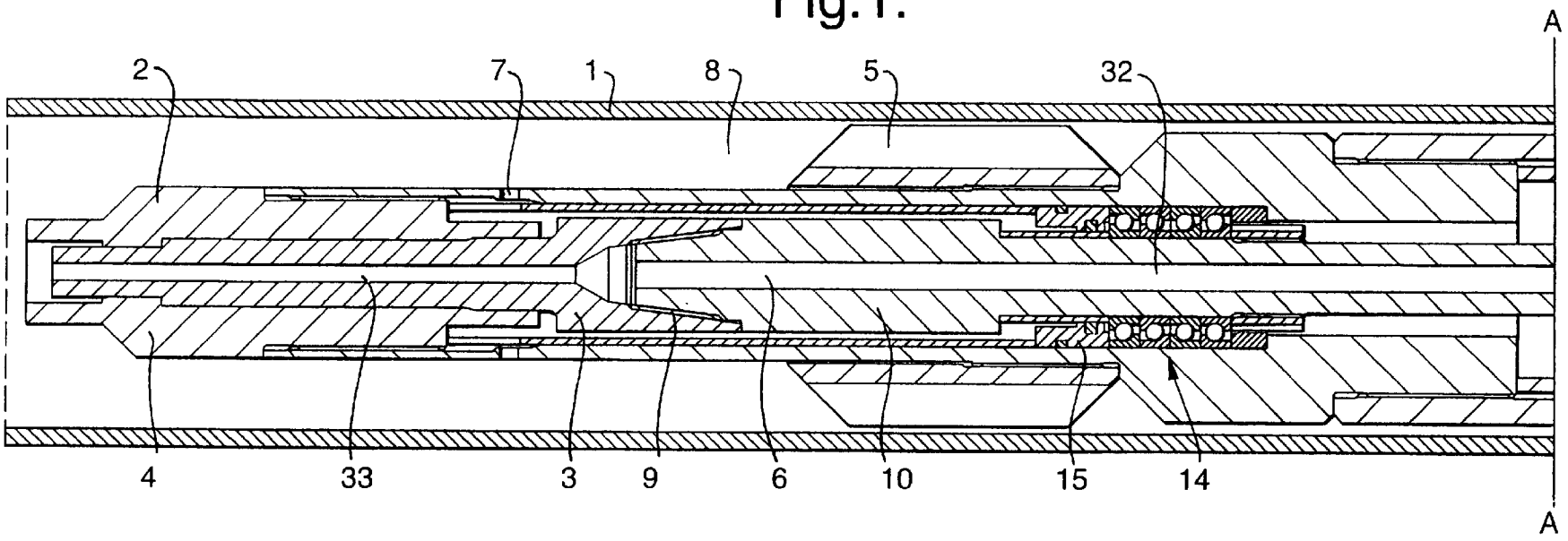
FIG. 1 shows a portion of an embodiment of the present invention from the top of the assembly to a line A—A.

Referring firstly to FIG. 1 the illustrated embodiment of the invention is shown located within a steel well casing 1. Typically, the casing would be cemented within a borehole passing through an oil or gas bearing formation. It should be appreciated, however, that the invention is also applicable to formation of slots in un-cased boreholes.

The present invention may be driven from any convenient motor, and in the illustrated embodiment is driven by a mud motor 2 having an output shaft 3 and a body 4. A suitable replaceable centralizing/stabilizing device 5 is located near the motor body to maintain the output shaft 3 substantially coincident with the longitudinal axis 6 of the borehole. A further stabilizing/centralizing device may be located on the body 4 of the motor if desired. In the illustrated embodiment of the invention the mud motor is of the type having non-sealed bearings and accordingly mud exiting the space between the shaft 3 and the body 4 flows via a passage 7 to the well annulus 8 surrounding the tool. In the alternative, a motor having sealed bearings may be used. Under these circumstances, the passage 7 merely provides for pressure equalization between the annulus 8 and the space surrounding the output shaft of the motor.

Figure 2:
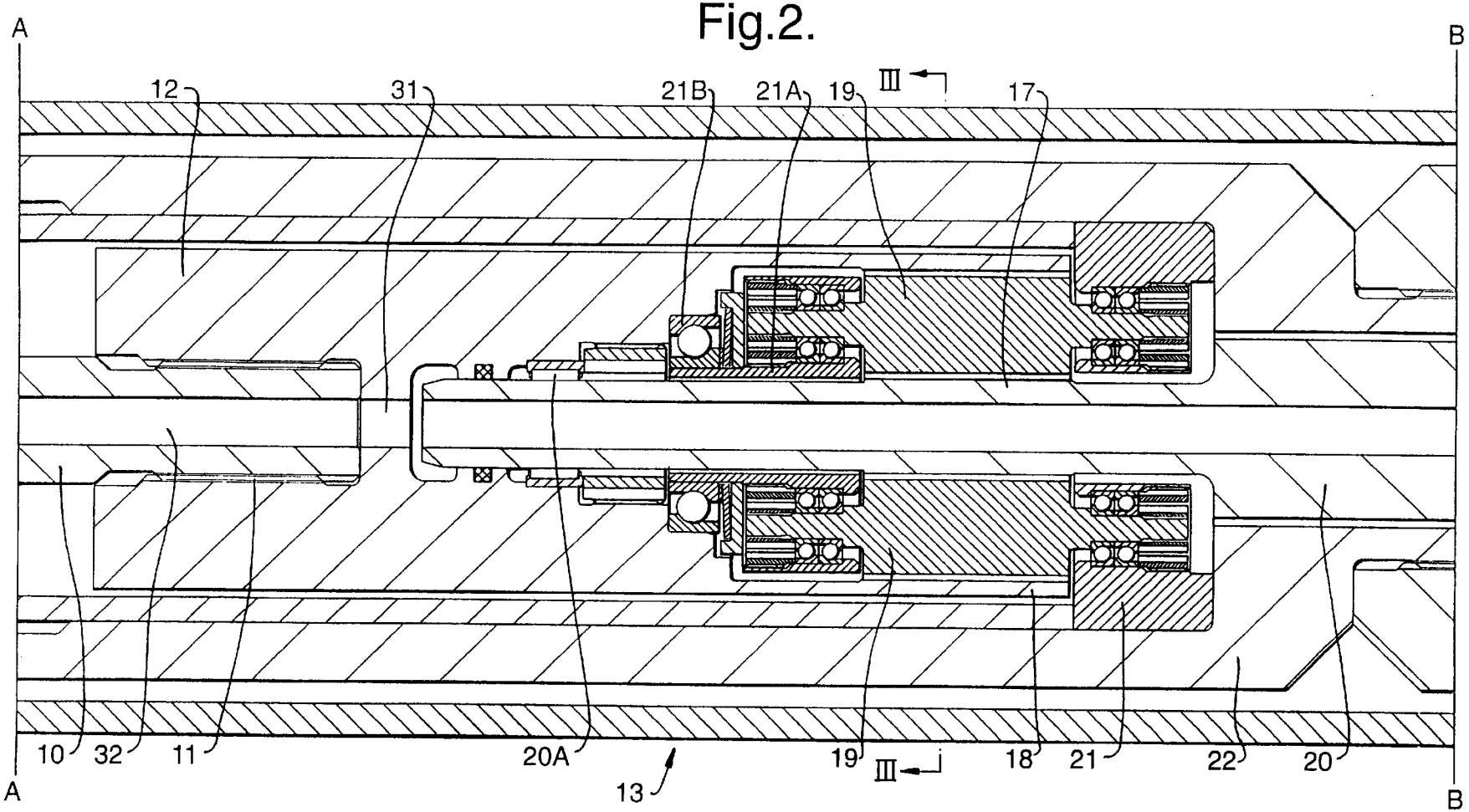
FIG. 2 shows the portion of an embodiment of the invention from the line A—A of FIG. 1 down to a line B—B.

The output shaft 3 is connected by a screw-threaded connection 9 to an intermediate shaft 10 which is itself connected by a screw-threaded connection 11 to the input shaft 12 of a gearbox 13 (FIG. 2). The intermediate shaft 10 is supported by bearings 14 which are sealed against ingress of mud by a seal assembly 15.

Figure 3:
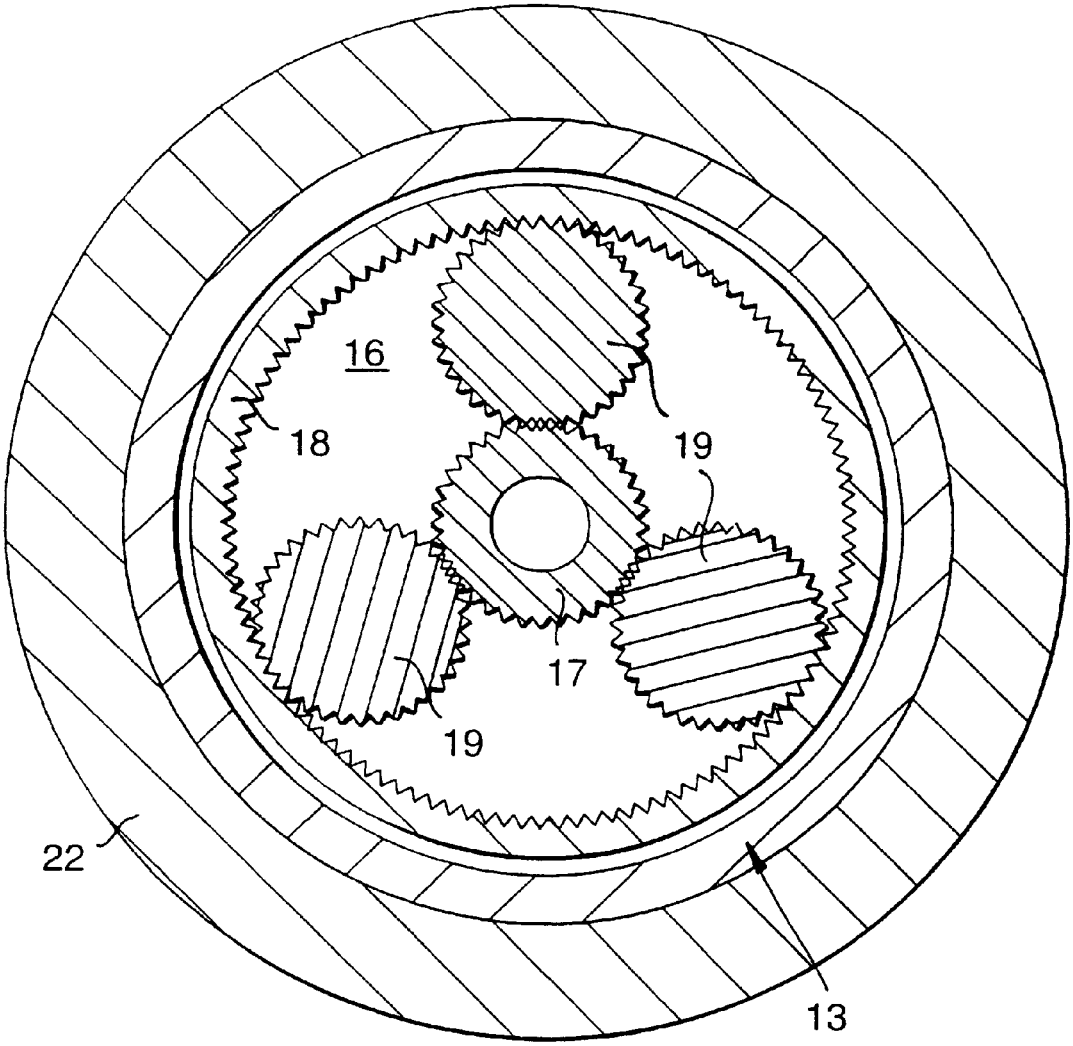
FIG. 3 is a cross-section on the line III—III of FIG. 2.
Figure 4:
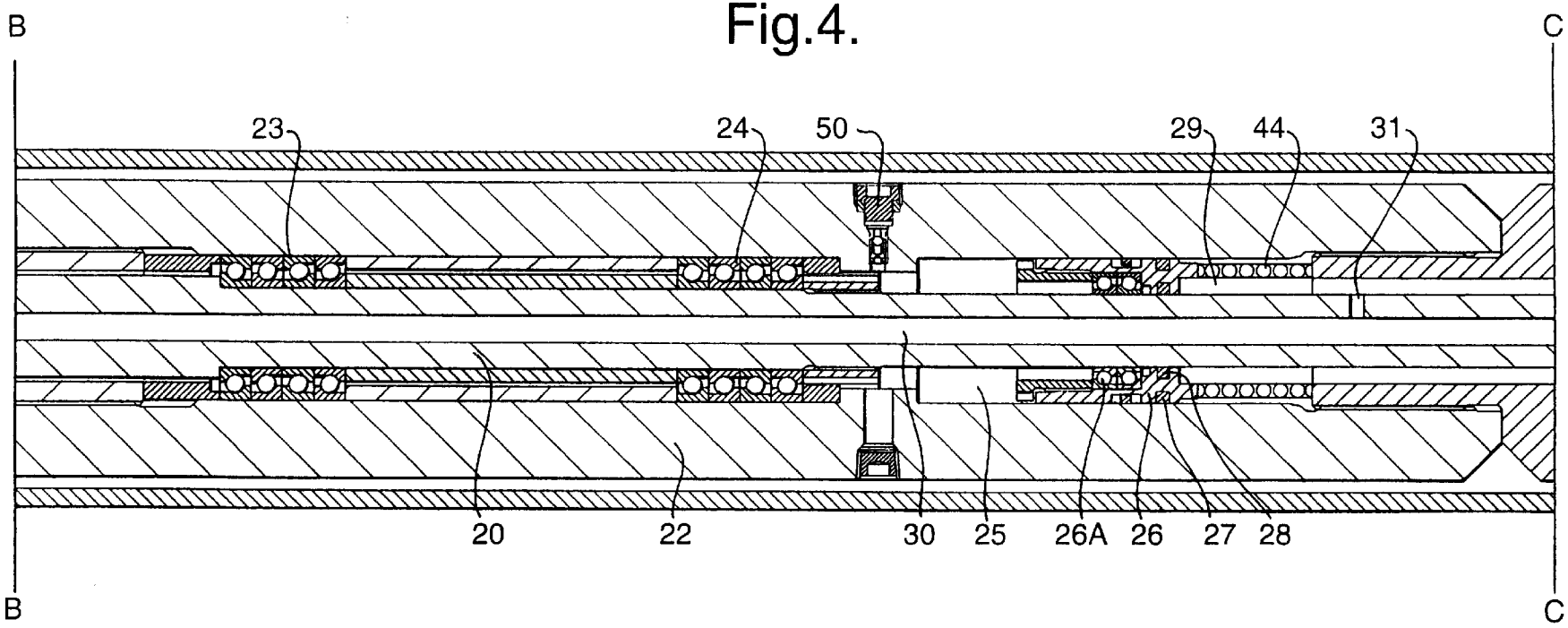
FIG. 4 shows a portion of an embodiment of the present invention from the line B—B to the line C—C, FIG. 4 being to the same scale as FIG. 1.

Referring now to FIGS. 2 and 3 the gearbox 13 is formed by an epicyclic gear set 16 comprising a sun gear 17, a ring gear 18 and planetary gears 19. The ring gear 18 is integral with the input shaft 12. The sun gear 17 is integral with an output shaft 20 which is rotatably supported on the input shaft 12 by suitable bearings 20A. The planetary gears 19 are each free to rotate about their own axes but are constrained against bodily rotation about the axis 6 by a carrier 21 which is secured under compression to the body 22 of the assembly. The ends of the planetary gears 19 remote from the carrier 21 are supported in ball bearings which are themselves mounted on a support ring 21A which is supported within the input shaft 12 by a bearing 21B.

As will be well understood by those skilled in the art, rotation of the input shaft 12 will cause rotation of the ring gear 18 which in turn will cause each planetary gear 19 to rotate about its own axis and to drive the sun gear 17. The sun gear will be rotated at a speed greater than the rotational speed of the ring gear. In the preferred embodiment of the invention the various components are sized such that rotational speed of the sun gear 17, and thus of the output shaft 20, is approximately three times the rotational speed of the input shaft 12.

The output shaft 20 is supported in rolling bearing systems 23,24,26. An annular lubricating oil reservoir 25 is formed between the output shaft 20 and the body 22 of the tool and is sealed at the lower end thereof by a floating piston 26 which carries oil seals 27,28. The annular zone 29 located below the floating piston 26 communicates with the central bore 30 of the output shaft 20 by means of a radial passage 31. The central bore 30 communicates with a corresponding central bore of the gearbox input shaft 12 which in turn communicates via a central bore 32 of the intermediate shaft 10 with the central bore 33 of the motor 2. The central bore 33 of the motor is connected to the interior of the drill pipe or coiled tubing upon which the motor is mounted and accordingly the central bores of the various components are subject to mud pressure supplied by the drill pipe/coiled tubing. This mud pressure is communicated via radial passage 31 to the annular zone 29 and accordingly acts on floating piston 26 to pressurize the lubricating oil reservoir 25. Additionally, a spring 44 acts on the piston 26 in the same direction as mud pressure to maintain a minimum pressure within the lubricant reservoir 25. An appropriate venting/charging assembly 50 is provided for charging the lubricant reservoir 25 after assembly of the tool. The entire internal portion of the body 22 between the floating piston 26 and the seal assembly 15, including the gearbox 13, is flooded with lubricating oil. Accordingly, the entire lubricant system will be pressurized by the spring 44 and mud pressure acting on the floating piston 26.

The floating piston 26 is supported on the output shaft 20 by bearings 26A the inner races of which are a sliding fit on the exterior of the shaft 20. This arrangement permits sliding movement of the piston 26 in use whilst at the same time permits rotation of the shaft 20 within the floating piston 26.

Referring now to FIGS. 4,5,7 and 8, the gearbox output shaft 20 terminates in a bevel gear 34 which is in driving engagement with a bevel gears 35 which are drivingly connected to the drive sprockets 36 of respective cutting chain assemblies 37. The cutting chain assemblies 37 are substantially identical to each other and, for convenience, only one of the cutting chain assemblies will be described in detail.

It should be appreciated that whilst the use of bevel gears 34,35 is the preferred means of drivingly connecting output shaft 20 to the drive sprockets of the chains of the cutting chain assemblies, other appropriate 90° driving arrangements may be used if preferred.

The cutting chain assemblies 37 each comprise a cutting chain 38 having cutting elements of or faced with tungsten carbide, diamond, or similar hard material. Each chain is driven by a drive sprocket 36 and is supported on a chain arm 39 carrying an idle sprocket 40 which guides the distal end of the chain 38. Accordingly, rotation of the gearbox output shaft 20 causes rotation of the bevel gear 34 to drive the bevel gears 35 which in turn drive the sprockets 36 to rotate the chains 38 about the sprockets 36,40.

Figure 5:
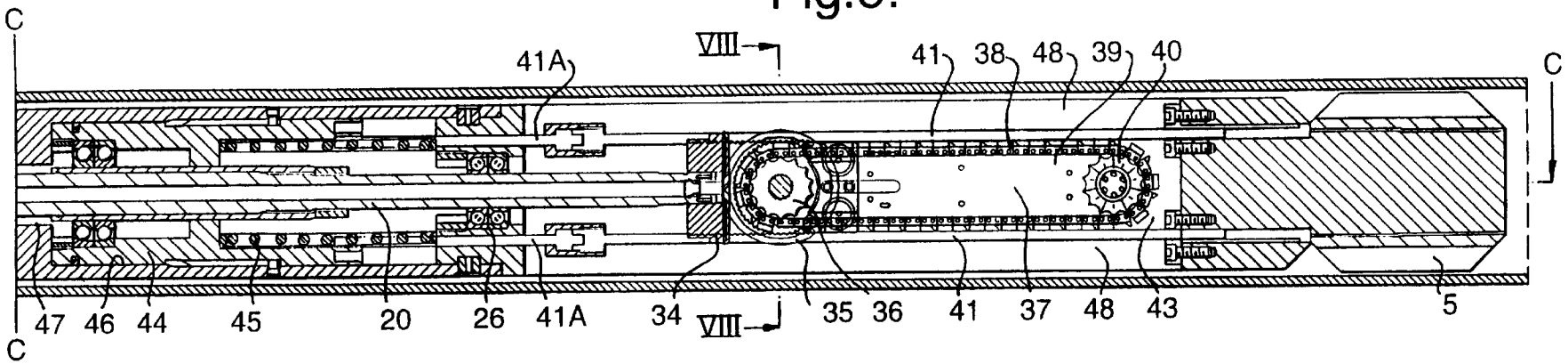
FIG. 5 is a view of a portion of an embodiment of the present invention from the line C—C to the bottom of the tool, FIG. 5 being to a smaller scale than FIG. 1.
Figure 6:
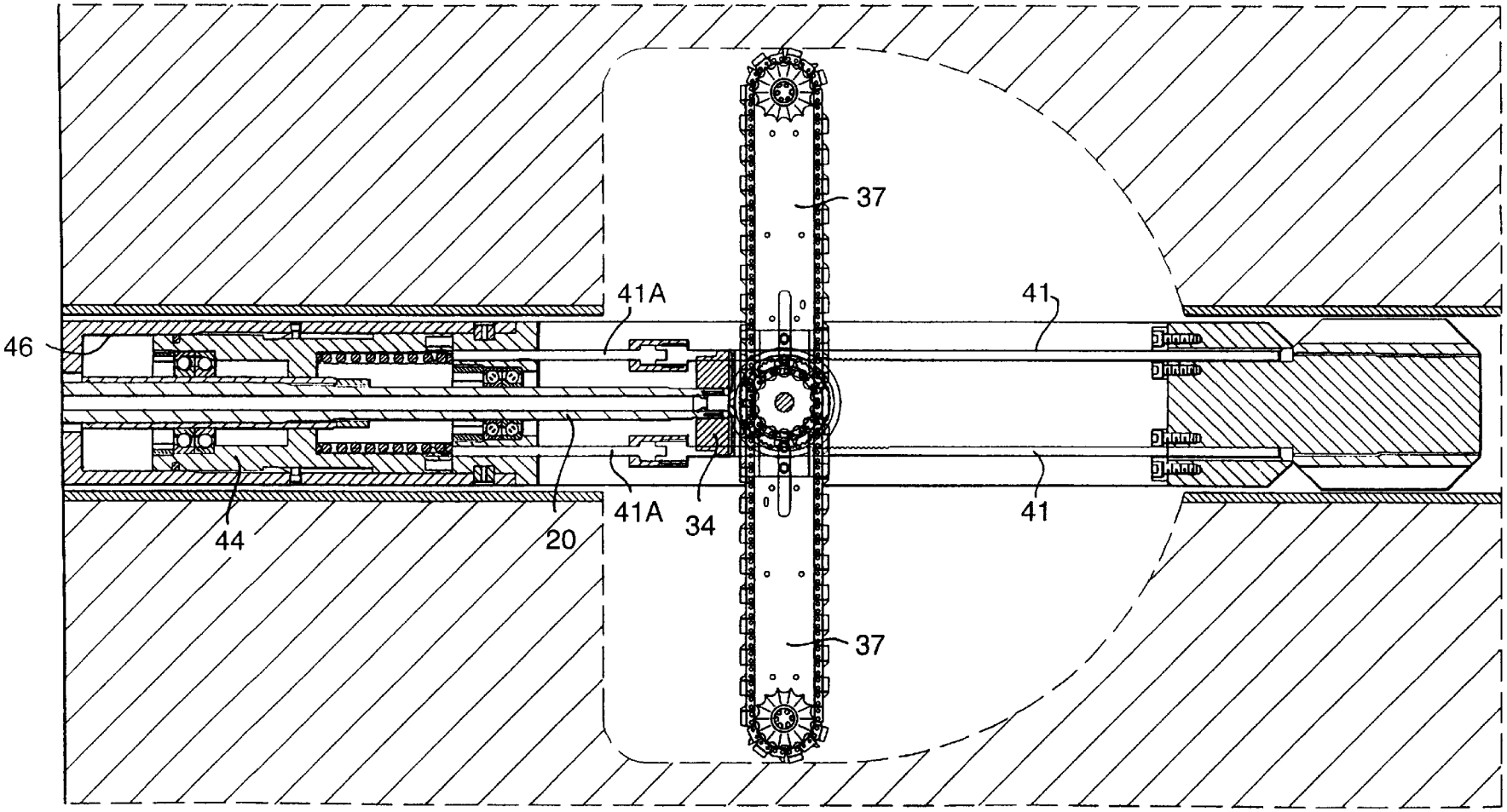
FIG. 6 is a view showing the same portion of the tool as that shown in FIG. 5 but with the chain arms are in their fully extended position.
Figure 7:
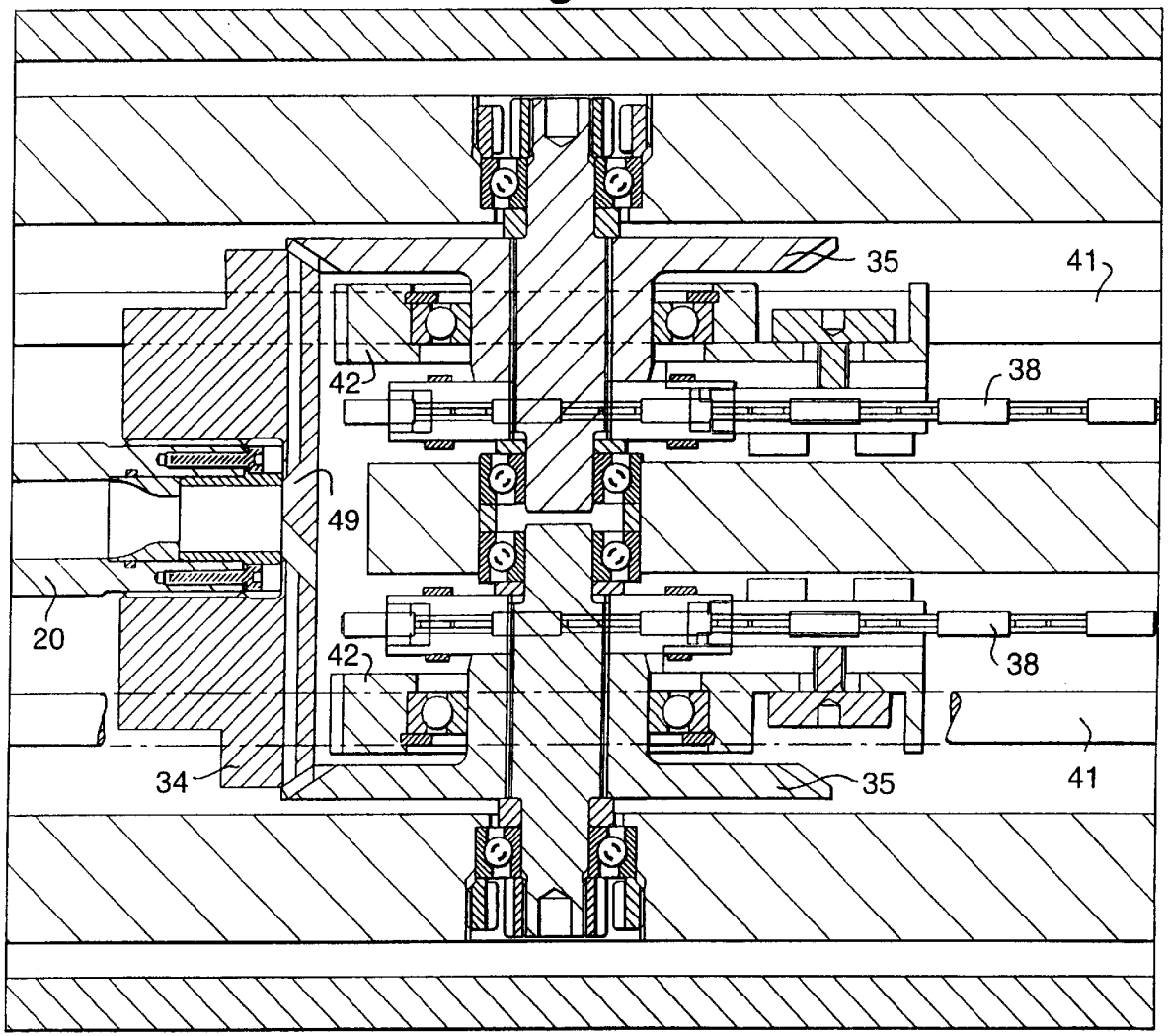
FIG. 7 is a detailed view of the chain drive arrangement of the preferred embodiment of the invention.
Figure 8:
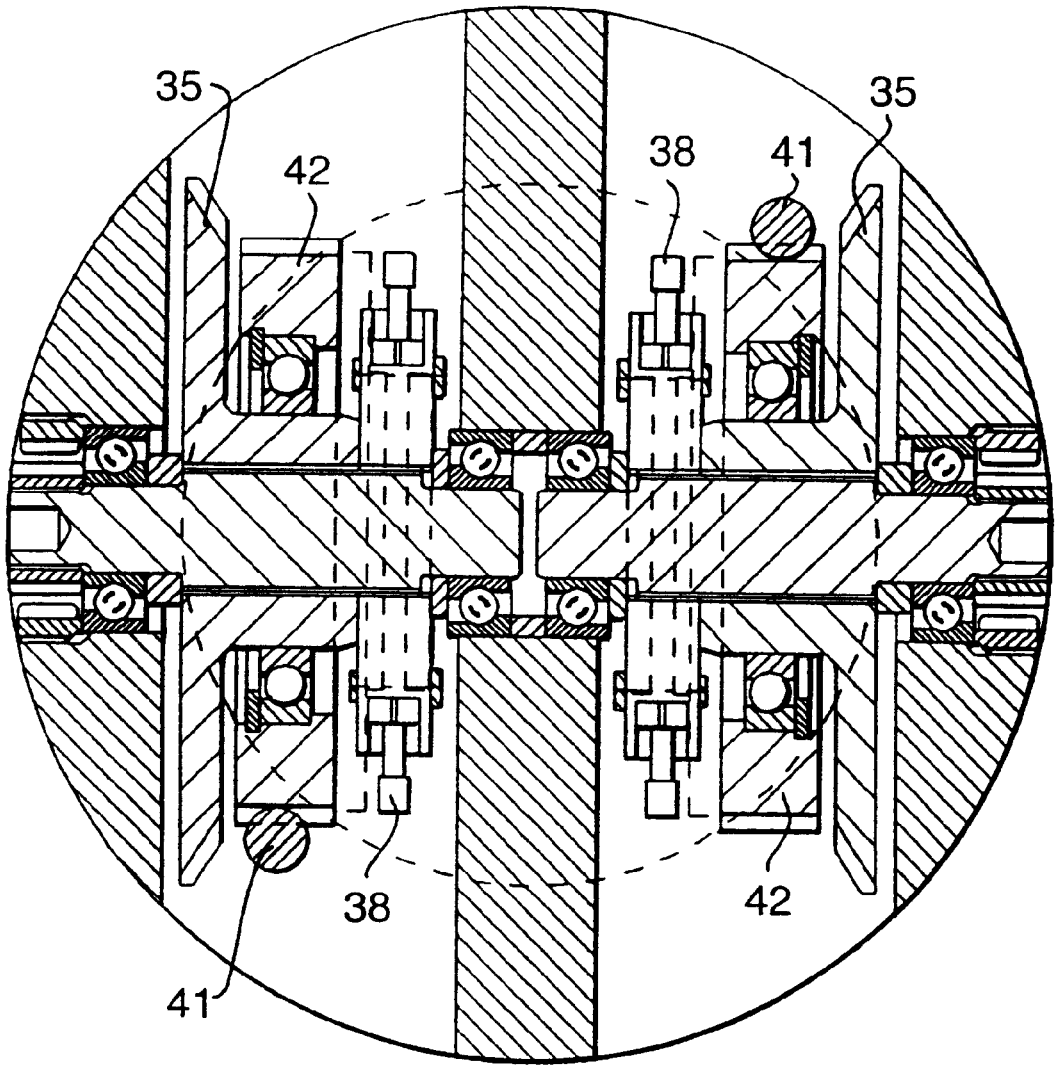
FIG. 8 is a cross-sectional view on the line VIII—VIII of FIG. 5.

The position of each chain assembly 37 is variable between that illustrated in FIG. 5 and that illustrated in FIG. 6 under the control of a rack members 41 each of which drives a pinion 42 secured to a respective chain arm 39. The chain arm is located in the position illustrated in FIG. 5 when the tool in run into the well, and in this position the chain is located wholly in the central passage 43 of the lower portion of the tool.

Movement of the rack members 41 is controlled by a sleeve piston 44 to which the racks are secured via connecting rods 41A. The sleeve piston 44 is biased in the up-hole direction by a spring 45 such that in the absence of fluid pressure the components adopt the configuration illustrated in FIG. 5. The piston 44 works within an annular cylinder 46 which is connected to the radial passage 31 by means of an annular clearance 47. Pressurization of the drill pipe or coiled tubing upon which the motor is mounted will simultaneously cause rotation of the motor and pressurization of the central passage 30 of the output shaft 20. Pressure within the central passage 30 will be communicated by the passage 31 and the clearance 47 to the annular cylinder 46 and will drive the piston 44 downwardly against the bias of spring 45 to move the racks 41 downwardly and rotate the chain arms outwardly in opposite directions through slots 48 provided in the tool body. By the time the distal end of the chains engage the interior of the well casing 1 the chains will be moving at the desired operating speed and cutting of the casing will commence. As the casing and surrounding formation is cut away the piston 44 will continue to move downwardly until the components reach the configuration illustrated in FIG. 6. Thereafter, if a longer slot is required the entire tool may be moved bodily upwardly or downwardly to increase the length of the slot by pulling or lowering of the drill pipe or coil tubing. Upward pulling is to be preferred to prevent breakage of the chain drive system.

Preferably, nozzles 49 are formed in the end of the shaft 20 such that a jet of mud is directed at each chain as it passes over its drive sprocket 36 to dislodge from the cutting elements portions of debris which may have lodged thereon.

In an alternative embodiment of the invention only one cutting chain assembly and associated rack is provided so that operation of the tool produces only one slot. Such an embodiment can be identical to that described above save that one cutting chain assembly and, optionally, the associated rack is omitted.

The lower ends of the racks 41 are preferably slidably supported in the body of the tool. A further replaceable stabilizer 5 is provided at the bottom of the tool. The stabilizers 5 are replaceable so that they can readily be replaced when they wear so as to maintain the maximum stability for the tool in operation.

It should be noted that in the above described embodiment of the invention the use of the gearbox 13 to increase the rotational speed of the input shaft of the chain mechanism as compared with the output shaft of the mud motor is of critical importance since a relatively high chain operating speed is essential for satisfactory operation of a chain having cutting elements of or dressed with tungsten carbide or diamond material. High speed is particularly needed by diamonds removing material by a grinding action. Further, the gearbox enables a motor to be utilized which has a substantial power output (at least 10 kW), thereby enabling substantial power to be applied to the chain mechanisms to effect rapid penetration of the casing and surrounding formations.

The use of a sleeve piston located below the motor and gearbox to control rotation of the chain arms means that this function can be effected without compromising the space required for or operation of either the motor or the gearbox. This is of particular importance if an embodiment of the present invention is designed for use in relatively small diameter tubing since it maximizes the space available for the motor and gearbox assemblies.

We claim:

1. An apparatus for forming an elongate slot in material surrounding the apparatus, the apparatus having a longitudinal axis and comprising at least one endless cutting chain mounted on at least one cutting arm having an axis; a motor for driving the chain, the motor having an output shaft located substantially coaxially with the longitudinal axis of the apparatus; drive means connecting the motor to a drive sprocket which itself is drivingly engaged with the chain; and means for rotating the cutting arm from an initial position in which the axis of the cutting arm is substantially parallel to the longitudinal axis of the apparatus to a final position in which the axis of the cutting arm extends obliquely or perpendicularly to the longitudinal axis of the apparatus; the rotating means comprising a sleeve piston which surrounds the drive means and is located below the motor, a rack driven by the sleeve piston, and a pinion driven by the rack and connected to the chain arm.

2. The apparatus according to claim 1 wherein there are two endless cutting chains mounted on respective cutting arms, each cutting chain having associated therewith a drive sprocket which is driven by a common drive means, wherein means are provided for rotating the cutting arms in mutually opposite directions from an initial position in which the axis of each cutting arm is substantially parallel to the longitudinal axis of the apparatus to a final position in which the axes of the cutting arms extend obliquely or perpendicularly to the longitudinal axis of the apparatus on opposite sides of the said longitudinal axis.

3. The apparatus according to claim 2 wherein the rotating means comprises a single sleeve piston which surrounds the drive means and is located below the motor and a pair of racks driven by the sleeve piston, each rack being drivingly connected to a respective pinion associated with a respective one of the chain arms so that movement of the sleeve piston simultaneously moves the chain arms in opposite directions.

4. The apparatus according to claim 1 wherein one or more replaceable stabilizers are mounted on the body of the apparatus for locating and stabilizing the apparatus within a well casing.

5. The apparatus according to claim 1 wherein the motor and drive sprocket are mounted so that the distance therebetween remains constant during rotation of the cutting arm.

6. The apparatus according to claim 1 wherein the motor and drive sprocket are mounted on a body of the apparatus.

7. The apparatus according to claims 1, 2, 3, 4, 5, or 6 further comprising a gear box located between the output shaft and the drive sprocket, the gearbox comprising an epicyclic gear set formed by a sun gear, a ring gear, and a set of planetary gears, one of the sun gear, the ring gear and the planetary gears being secured to the output shaft of the motor and another of the sun gear, the ring gear and the planetary gears being secured to a body of the motor.

8. The apparatus according to claim 1 further comprising a gear box located between the output shaft and the drive sprocket, the gearbox comprising an epicyclic gear set formed by a sun gear, a ring gear, and a set of planetary gears, one of the sun gear, the ring gear and the planetary gears being secured to the output shaft of the motor and another of the sun gear, the ring gear and the planetary gears being secured to a body of the motor.

9. The apparatus according to claim 8 wherein the motor has an output power in excess of 10 kW and the gear box acts as a step-up gear box to rotate each drive sprocket at a rotational speed greater than the rotational speed of the output shaft of the motor.

10. The apparatus according to claim 9 wherein the gearbox has a step-up ratio of approximately 3:1.

11. The apparatus according to claim 8 wherein the drive means comprises a shaft which extends along the longitudinal axis of the apparatus from the gear box to a bevel gear, and wherein the or each chain drive sprocket is drivingly connected to a bevel gear which is in mesh with the bevel gear of the drift shaft.

12. The apparatus according to claim 8 wherein the gear box is located below the drive motor and above a sleeve piston.

* * * * *